United States Patent [19]

Malhotra

[11] Patent Number: 4,592,954

[45] Date of Patent: Jun. 3, 1986

[54] INK JET TRANSPARENCIES WITH COATING COMPOSITIONS THEREOVER

[75] Inventor: Shadi L. Malhotra, Mississauga, Canada

[73] Assignee: Xerox Corporation, Stamford, Conn.

[21] Appl. No.: 695,026

[22] Filed: Jan. 25, 1985

[51] Int. Cl.[4] ..... B41M 5/00

[52] U.S. Cl. ..... 428/335; 346/135.1; 428/195; 428/481; 428/483; 428/507; 428/508; 428/509; 428/516; 428/518; 428/532; 428/534; 428/536

[58] Field of Search ..... 346/1.1, 135.1; 400/126; 427/261, 288; 428/207, 211, 532, 534, 535, 536, 537.5, 195, 335, 481, 483, 507–509, 516, 518

[56] References Cited

U.S. PATENT DOCUMENTS

| | | | |
|---|---|---|---|
| 2,982,681 | 5/1961 | Crampsey et al. | 154/46 |
| 3,489,597 | 1/1970 | Parker | 117/73 |
| 3,788,881 | 1/1974 | Tellier | 117/73 |
| 3,870,549 | 3/1975 | Ruygrok | 117/73 |
| 4,251,400 | 2/1981 | Columbus | 260/8 |
| 4,269,891 | 5/1981 | Minagawa | 428/211 |
| 4,308,542 | 12/1981 | Maekaua et al. | 428/537.5 |
| 4,371,582 | 2/1983 | Sugiyama et al. | 428/207 |
| 4,448,850 | 5/1984 | Upson et al. | 428/510 |

FOREIGN PATENT DOCUMENTS

| | | | |
|---|---|---|---|
| 2034806 | 9/1975 | Japan | 428/207 |

OTHER PUBLICATIONS

IBM Tech. Disclosure Bulletin, vol. 21, No. 6, Nov. 1978, p. 2505, Crooks and Melz.

IBM Tech. Disclosure Bulletin, vol. 22, No. 8A, Jan. 1980, pp. 3301, 3302; Edds, Elbert and Stone.

*Primary Examiner*—Bruce H. Hess

*Attorney, Agent, or Firm*—E. O. Palazzo

[57] ABSTRACT

A transparency for ink jet printing comprised of a supporting substrate and thereover a coating consisting essentially of a blend of carboxymethyl cellulose, and polyethylene oxides. Also disclosed are papers for use in ink jet printing comprised of a plain paper substrate and a coating thereover consisting essentially of polyethylene oxides.

7 Claims, No Drawings

INK JET TRANSPARENCIES WITH COATING COMPOSITIONS THEREOVER

BACKGROUND OF THE INVENTION

This invention relates generally to coatings for ink jet transparencies, and ink jet paper; and more specifically, the present invention is directed to the use of coatings for various substrates so as to enable the achievement of acceptable optical density while simultaneously allowing the rapid drying of the inks selected for development. The coated substrates, inclusive of the transparencies and papers, generated in accordance with the present invention are particularly useful in ink jet printing processes. Also, the coated papers can be useful in electrostatographic imaging processes.

Ink jet printing systems are well known thus, for example, there is described in U.S. Pat. No. 3,846,141 a composition useful in ink jet printing comprised of an aqueous solution of a water-soluble dye and a humectant material formed of a mixture of a lower alkoxy triglycol, and at least one other compound selected from the group consisting of a polyethylene glycol, a lower alkyl ether of diethylene glycol, and glycerol. According to the disclosure of this patent, the viscosity of the printing inks is subjected to little variation with use in that water is lost by evaporation during recirculation of the ink composition through the jet printer. Moreover, apparently the humectant system disclosed in this patent substantially prevents or minimizes tip drying of the printing ink in the orifice or nozzle during down time of the printer such as when the printer is rendered inoperative. As further disclosed in this patent, the basic imaging technique in jet printing involves the use of one or more ink jet assemblies connected to a pressurized source of ink. Each individual ink jet includes a very small orifice usually of a diameter of 0.0024 inches, which is energized by magneto restrictive piezo-electric means for the purpose of emitting a continuous stream of uniform droplets of ink at a rate of 33 to 75 kilohertz. This stream of droplets is desirably directed onto the surface of a moving web of, for example paper, and is controlled to form printed characters in response to video signals deirved from an electronic character generator and in response to an electrostatic deflection system.

Also, there is disclosed in U.S. Pat. No. 4,279,653 ink jet compositions containing water-soluble wetting agents, a water-soluble dye and an oxygen absorber. Similarly, U.S. Pat. No. 4,196,007 describes an ink jet printing composition containing an aqueous solution of a water-soluble dye and a humectant consisting of at least one water-soluble unsaturated compound. Other patents disclosing aqueous inks for ink jet printing include U.S. Pat. Nos. 4,101,329; 4,290,072; and 4,299,630.

Further, disclosed in U.S. Pat. No. 4,273,602, are heat sensitive recording materials comprised of a support sheet of a thickness of from 5 to 40 microns containing thereon a heat sensitive transfer layer with a phenolic material, a colorless or precolored material which reacts with the phenolic material to form color upon application of heat, and a heat fusible material having a melting point of 40° C. to 150° C., with an image receiving sheet superimposed on the surface of this layer. It is indicated in this patent that heat sensitive transfer layers can be formed from waxes or resins of low molecular weight, with colored dyes dispersed therein, however, apparently there are problems associated with such a method in that part of the layer transfers to ordinary paper causing undesirable staining and a decrease in contrast between letters and the background. Accordingly, the recorded letters cannot be easily read.

Also known is the preparation of transparencies by electrostatic means. There is thus disclosed, for example, in U.S. Pat. No. 4,370,379 a method for preparing an original for projection according to electrophotographic processes. More specifically, it is indicated in this patent that the conventional method for preparing a projection original for an overhead projector, (a transparent sheet), according to electrostatic photography comprises transferring a toner image formed on a photosensitive plate onto a stretched polyester film, and fixing the transferred toner image on the film by heat. Various plastic films can be used for this purpose including biaxially stretched polyester film. It is further indicated in this patent that the transfer film selected for electrostatic photography is comprised of a film substrate which is transparent such as a biaxially stretched polyethylene terephthalate film including Mylar films.

Moreover, there is disclosed in U.S. Pat. No. 4,234,644, a composite lamination film for electrophoretically toned images deposited on a plastic dielectric receptor sheet comprising in combination an optically transparent flexible support layer, and an optically transparent flexible intermediate layer of a heat softenable film applied to one side of the support layer wherein the intermediate layer possesses good adhesion to the support layer. It is indicated in this patent that the support layer 11 can be prepared from various suitable substances including polycarbonates, polysulfones, polyethylene terephthalates, Mylars, and the like.

While the above transparencies are suitable for their intended purposes, there remains a need for ink jet transparencies and for coatings for ink jet paper which will enable the rapid drying of the inks selected. Additionally, there remains a need for coatings for ink jet transparencies which are compatible with the supporting substrate and the ink compositions selected for marking.

SUMMARY OF THE INVENTION

It is thus an object of the present invention to provide ink jet transparencies and coatings for ink jet paper which overcome some of the above-noted disadvantages.

In another object of the present invention there are provided ink jet transparencies with specific coatings thereover.

A further object of the present invention resides in the selection of specific polymeric coatings for substrates, particularly Mylar substrates, which coatings promote water and glycol absorption from the ink used for marking in known ink jet printers.

In still another object of the present invention there are provided coatings for ink jet paper which are compatible with the paper and will enable rapid drying of the inks selected for marking.

It is still another object of the present invention to provide polymeric coatings for substrates, particularly Mylar substrates, and paper products, which coatings promote water absorption from the ink used for marking, and drying within a period of less than about 20 seconds enabling their usefulness in various printers including the commercially available Diablo printers.

These and other objects of the present invention are accomplished by providing polymeric coatings for certain substrates. More specifically, in accordance with the present invention there are provided polymeric coatings for ink jet transparencies, and ink jet paper, which coatings are compatible with the inks selected for marking, and wherein the coatings permit rapid drying of the ink compositions selected in ink jet printing processes. In one embodiment, thus the present invention is directed to ink jet transparencies comprised of a supporting substrate and a coating thereover consisting essentially of a mixture of carboxymethyl cellulose and polyethylene oxides. In another specific embodiment of the present invention there are provided coatings for ink jet paper comprised of a supporting substrate and a coating thereover consisting essentially of a mixture of carboxymethyl cellulose and polyethylene oxides.

Examples of substrates selected for the ink jet transparencies include Mylar, commercially available from E. I. duPont; Melinex, commercially available from Imperials Chemical, Inc.; Celanar, commercially available from Celanese; polycarbonates, especially Lexan; polysulfones; cellulose triacetate; polyvinylchlorides; and the like, with Mylar being particularly preferred in view of its availability and lower costs. The substrate selected for the transparencies are generally of a thickness of from about 50 microns to about 100 microns, and preferably are of a thickness of from 50 microns to about 70 microns. Thicknesses outside these ranges can be selected provided the objectives of the present invention are achieved.

Illustrative examples of coatings that can be selected for the aforementioned ink jet transparency substrates, or for known ink jet papers include blends of carboxymethyl cellulose and polyethylene oxides; blends of carboxymethyl cellulose and cellulose; blends of hydroxy ethyl cellulose and cellulose; blends of methyl cellulose and polyvinyl pyrrolidone; and blends of methyl cellulose and polyvinyl methyl ether. Particularly preferred are blends of carboxymethyl cellulose and polyethylene oxides. When blends are selected from about 40 percent by weight to about 60 percent by weight of one component, to about 60 percent by weight to about 40 percent by weight of the second component are selected. Thus, for example, with a blend of carboxymethyl cellulose and polyethylene oxides there is selected from about 40 to 60 percent by weight of carboxymethyl cellulose, and from about 60 to 40 percent by weight of polyethylene oxides. Specific examples of coatings selected include blends of carboxymethyl cellulose (CMC), Type 7HOF, Hercules, 50 percent by weight and poly (ethylene oxide) (PEO), Molecular Weight $M=2.0\times10^5$, 50 percent by weight in water; blends of hydroxy ethyl cellulose Type 250 LR Hercules, 50 percent by weight; and 50 percent by weight of PEO poly (ethylene oxide), poly (vinyl alcohol), 75 percent hydrolyzed, M=3,000, 40 percent by weight and poly (ethylene imine), 10 percent by weight in water; blends of hydroxy propyl methyl cellulose, Type K35LV, Dow Chemicals, 90 percent by weight and poly (ethylene glycol monomethyl ether), M=750, 10 percent by weight in water; blends of carboxy methyl cellulose, Type 7HOF, 50 percent by weight and poly (vinyl alcohol), 88 percent hydrolyzed, M=10,000, 50 percent by weight in water; and blends of hydroxy ethyl cellulose, 50 percent by weight, and vinyl pyrrolidone/diethylaminomethylmethacrylate copolymer, 50 percent by weight in water. The preferred coating or sizing for the ink jet papers is polyethylene oxide.

These polymer coatings are present on the substrates or the papers, in various thicknesses; generally however, thicknesses of from about 30 microns to about 50 microns, and preferably from about 30 microns to about 35 microns are used. Also, the coatings are applied by known methods including Kiegen coaters and dip coating processes.

In one specific embodiment, the ink jet transparencies of the present invention are prepared by providing a Mylar substrate in a thickness of from about 50 to about 100 microns; and applying thereto by dip coating processes, in a thickness of from about 30 to 35 microns, a polymer mixture comprised of 50 percent by weight of carboxymethyl cellulose, and 50 percent by weight of polyethylene oxides. Coating is affected from a solution having incorporated therein the polymer mixture. Thereafter, the coating is air dried and the resulting transparency can then be introduced into a printer, such as a Diablo printer, with a paper backing.

The coatings of the present invention enable the rapid drying of inks selected for marking, and also allow for expedited absorption of these inks. Specifically thus with reference, for example, to the commercially available Diablo Series C ink jet printers, the coatings of the present invention enable the absorption of water from water based inks in relatively short time periods, less than for example 1 minute, while simultaneously maintaining the dye in the ink on the surface thus allowing maximum optical density to be achieved in the dried image. In contrast, many of the coated transparencies commercially available do not allow the dye to remain on the surface, and therefore the resulting dried image has a much lower optical density than is achievable with the coatings of the present invention.

The following examples are being supplied to further define various species of the present invention, it being noted that these examples are intended to illustrative only and not intended to limit the scope of the present invention; parts and percentages are by weight unless otherwise indicated.

EXAMPLE I

There was prepared a coated transparency Mylar sheet of a thickness of 50 microns by affecting a dip coating of this sheet into a blend of poly(ethylene oxide), 60 percent by weight, and carboxymethyl cellulose, 40 percent by weight, which blend was present in a concentration of 10 percent by weight in water. Subsequent to drying in air, and by monitoring the differences in weight prior to and subsequent to coating, the sheet coated had present on each side 500 milligrams, 30 microns thickness, of the polymer blend. This sheet was then individually fed into a Diablo ink jet color printer, having incorporated therein separate developer inks containing magenta, cyan, yellow and black dyes respectively, and there were obtained images of high resolution and optical densities of 1.58 (magenta), 1.71 (cyan), 1.47 (yellow), and 1.85 (black); and these images could not be erased by hand wiping 1 minute subsequent to their preparation. In contrast, images made in the same manner with coated Mylar transparencies commercially available from Minnesota, Mining and Manufacturing had much lower densities subsequent to being fed into the Diablo ink jet color printer, that is, densities of 0.8 (magenta), 0.78 (cyan), 0.89 (yellow) and 0.86

(black). Higher optical densities translate into superior color quality for the resulting images.

The optical density measurements were affected on Pacific Spectrograph Color System. The system consists of two major components: an optical sensor and a data terminal. The optical sensor employs a 6 inch integrating sphere to provide diffuse illumination and 8 degrees viewing. This sensor can be used to measure both transmission and reflectance samples. When reflectance samples are measured, a specular component may be included. A high resolution, full dispersion, grating monochromator was used to scan the spectrum from 380 to 720 nm. The data terminal features a 12 inch CRT display, numerical keyboard for selection of operating parameters, and the entry of tristimulus values; and an alphanumeric keyboard for entry of product standard information.

EXAMPLE II

The procedure of Example I was repeated with the exception that there was coated a Mylar sheet with a blend of hydroxyethyl cellulose, 50 percent by weight, poly(vinylalcohol), 40 percent by weight, and poly(ethylene imine), 10 percent by weight, which blend was present in a concentration of 10 percent by weight in a water solution. Images obtained on these coated Mylar sheets, which could not be erased by hard wiping 1 minute subsequent to their preparation, that is, the image was totally dry, had optical densities of 0.98 (magenta), 0.92 (yellow), 0.91 (cyan) and 1.05 (black), as determined in accordance with the procedure of Example I. The optical densities for images obtained on coated Mylar sheets available from Minnesota, Mining and Manufacturing Company were as reported in Example I.

EXAMPLE III

The procedure of Example I was repeated with the exception that there was selected as the coating a blend of hydroxypropylmethyl cellulose, 90 percent by weight, and poly(ethylene glycol monomethylether), 10 percent by weight. Substantially similar results were obtained as reported in Example II.

EXAMPLE IV

There was coated (dip coating) a 4024 paper sheet, without paper sizing, commercially available from Domtar Cornwall, with polyethylene oxide, PEO, molecular weight $2.0\times10^5$, present in water, 10 percent by weight. The resulting sheet was then dried at 100 degrees centigrade on a dynamic sheet former dryer for 10 minutes. Subsequently, the sheet was fed into the Diablo ink jet color printer by repeating the procedure of Example I and images of high resolution were obtained. The optical density of a resulting image was 1.23 (magenta), 1.29 (cyan), 1.20 (yellow) and 1.28 (black). Images generated in the same manner with the more costly Diablo coated papers, commercially available, had optical densities of 1.18 (magenta), 1.45 (cyan), 1.43 (yellow) and 1.02 (black).

Other modifications of the present invention may occur to those skilled in the art based upon a reading of the present disclosure, and these modifications are intended to be included within the scope of the present invention.

I claim:

1. A transparency for ink jet printing comprised of a supporting substrate and thereover a coating consisting essentially of 40 to 60 percent by weight of carboxymethyl cellulose, and 60 to 40 percent by weight of polyethylene oxides.

2. A transparency in accordance with claim 1 wherein the supporting substrate is cellophane.

3. A transparency in accordance with claim 1 wherein the substrate is a polyester.

4. A transparency in accordance with claim 1 wherein the substrate is polyvinyl chloride.

5. A transparency in accordance with claim 1 wherein there is achieved rapid drying of a jet ink selected for marking on the transparency.

6. A transparency in accordance with claim 1 wherein the coating thickness is from about 50 microns to about 75 microns.

7. A transparency in accordance with claim 1 wherein the coating consists of about 50 percent by weight of carboxymethyl cellulose and about 50 percent by weight of polyethylene oxide.

* * * * *